8-107 SR
3/29/88 XR 4,734,098

United States Patent [19]
Wilson

[11] Patent Number: 4,734,098
[45] Date of Patent: Mar. 29, 1988

[54] METHOD FOR BLEACHING COTTON

[75] Inventor: Robert B. Wilson, Greenville, S.C.

[73] Assignee: Crucible Chemical Company, Greenville, S.C.

[21] Appl. No.: 800,727

[22] Filed: Nov. 22, 1985

[51] Int. Cl.[4] ..... D06L 3/02; D06L 3/14
[52] U.S. Cl. ..... 8/111; 8/107
[58] Field of Search ..... 8/111, 107

[56] References Cited

U.S. PATENT DOCUMENTS

| | | | |
|---|---|---|---|
| 2,886,532 | 5/1959 | Richmond et al. | 252/104 |
| 3,353,903 | 11/1967 | Potter et al. | 8/111 |
| 3,397,033 | 8/1968 | Ney et al. | 8/111 |
| 3,595,603 | 7/1971 | Cerana | 8/111 |
| 3,925,008 | 12/1975 | Makino et al. | 8/111 |
| 3,957,428 | 5/1976 | Massey et al. | 8/111 |
| 4,013,575 | 3/1977 | Castrantas et al. | 252/104 |
| 4,014,805 | 3/1977 | Castrantas | 252/104 |
| 4,378,967 | 4/1983 | Yostsuya et al. | 8/111 |
| 4,379,353 | 4/1983 | Holderer et al. | 8/149.1 |
| 4,394,126 | 7/1983 | Wilson | 8/115.6 |

*Primary Examiner*—Paul Lieberman
*Assistant Examiner*—Linda D. Skaling
*Attorney, Agent, or Firm*—Bailey & Hardaway

[57] ABSTRACT

A method for bleaching cotton substrates comprises the steps of:

(a) immersing an unbleached cotton substrate in an aqueous hydrogen peroxide solution at pH 4.5–11 at 15°–90° C. to saturate the cotton substrate with hydrogen peroxide solution;

(b) removing the thus-saturated cotton substrate from the aqueous hydrogen peroxide solution and removing from the substrate hydrogen peroxide solution in excess of 50–500% by weight pick-up;

(c) transferring the resulting cotton substrate to a bath of an inert high boiling organic heating medium at a temperature between 100° C. and the boiling or decomposition point of the organic heating medium 5 sec-20 min and (d) removing the cotton substrate from the organic heating medium and separating entrained organic heating medium therefrom.

The organic heating medium preferably comprises one or more of:

A. an aromatic polyester of the formula $C_6H_{z'}$—(-$COOR_1)_z$, wherein z is 3, 4, 5, or 6; z' is 6-z and $R_1$ is higher alkyl;

B. a cycloaliphatic diester of the formula

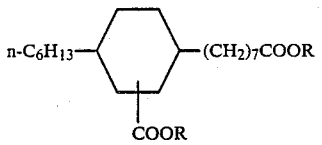

wherein R is substituted or unsubstituted straight or branched chain alkyl of 4–20 carbon atoms or polyoxyalkylene of the formula $HO(C_xH_yO)_nC_xH_y$—;

C. a bisterephthalate ester of an alkylphenylpolyoxyethanol;

D. a triglyceride fat or oil;

E. a silicone oil;

F. a halogenated hydrocarbon;

G. a glycol or glycol ether or

H. a hydrocarbon wax or oil.

17 Claims, No Drawings

METHOD FOR BLEACHING COTTON

DESCRIPTION

1. Technical Field

This invention relates to a process for bleaching cotton substrates, including fibers, fabrics or articles, in which cotton substrate is saturated with aqueous hydrogen peroxide solution and then heated in an inert high boiling organic heating medium.

2. Background Art

Makino et al. (U.S. Pat. No. 3,925,008) have proposed a method for simultaneously scouring and bleaching textile fiber materials by treating the materials with a peroxide bleahing agent in a non-aqueous medium consisting of an organic carbonate dissolved, dispersed or emulsified in a halogenated hydrocarbon. The material is impregnated with the bleaching composition at a temperature below about 40° C. and then heated with steam at 70°–150° C.

Ney et al., in U.S. Pat. No. 3,397,033, have proposed bleaching textiles by impregnating the fibrous textile material with aqueous peroxide bleaching solution, removing excess peroxide solution, storing the impregnated material for 3–10 h and then treating the textile material with steam at 120°–200° C.

Yotsuya et al. (U.S. Pat. No. 4,378,967) have disclosed bleaching fibrous materials with hydrogen peroxide by first treating the materials with hydrogen peroxide at pH 5–7 and then at pH 8.5–11.

Westall (U.S. Pat. No. 3,370,911) has proposed rapidly bleaching cotton yarn warp by contacting the cotton warp with an aqueous solution of a bleaching agent and steaming the warp with bleaching agent adhered thereto. Potter et al. (U.S. Pat. No. 3,353,903) recite conditioning greige cotton fabrics for dyeing by treatment with a caustic alkali solution, a solution of hydrogen peroxide and steam .

Katz (U.S. Pat. No. 3,918,898) has recited simultancous scouring, desizing and bleaching of cotton greige goods by treatment with heated aqueous hydrogen peroxide solution, in the absence of other additives, at pH 10–14. See also Cerena, U.S. Pat. No. 3,595,603.

Sitver et al, in U.S. Pat. No. 3,704,188, have proposed simultaneous desizing, scouring and bleaching of greige textiles by treatment with an aqueous alkaline hydrogen peroxide medium, containing a dipersulfate, a petroleum distilate fraction, a stabilizer and a surfactant.

Davies et al., in U.S. Pat. No. 2,955,905, have proposed using a peroxide-ester bleaching composition for bleaching fabrics, particularly cotton.

Among the deficiencies of the processes presently known are the necessity for lengthy, multi-step processes, often requiring 3–5 hours and multiple treatments in a J-box.

It is therefore an object of this invention to provide a rapid, effective process for bleaching greige textile materials, particularly greige cotton.

DISCLOSURE OF THE INVENTION

This invention relates to a method for bleaching cotton substrates by the steps of:

(a) immersing unbleached cotton substrate in an aqueous solution of hydrogen peroxide at pH 4.5–11 at 15°–90° C. to saturate the cotton substrate with the aqueous solution of hydrogen peroxide;

(b) removing the thus-saturated cotton substrate from the aqueous solution of hydrogen peroxide and removing from the substrate aqueous hydrogen peroxide solution in excess of 50–100% pick-up by weight;

(c) transferring the resulting cotton substrate to a bath of an inert high boiling organic heating medium at a temperature between 100° C. and the boiling point or decomposition point of the organic heating medium for 5 sec-20 min; and (d) removing the cotton substrate from the high boiling organic heating medium and separating entrained organic heating medium from the cotton substrate.

The organic heating medium comprises one or more of:

A. an aromatic polyester of the formula $C_6H_{z'}(COOR_1)_{z'}$ wherein z is 3, 4, 5 or 6; z' is 6 - z; $R_1$ is substituted or unsubstituted higher alkyl or an alkylphenol ether of an alkoxyalkanol;

B. a diester of a hydrogenated Diels-Alder adduct of linoleic and acrylic acids;

C. a bisterephthalate ester of an alkylphenylpolyoxyethanol;

D. a triglyceride fat or oil of the formula $$\begin{array}{l} CH_2O\text{—acyl} \\ | \\ CHO\text{—acyl}' \\ | \\ CH_2O\text{—acyl}'' \end{array}$$

wherein acyl, acyl' and acyl'' are independently selected from saturated or unsaturated substituted or unsubstituted alkanoyl of an even number of carbon atoms from 10–30 carbon atoms;

E. a silicone oil;

F. a halogenated hydrocarbon;

G. a glycol or glycol ether or

H. a hydrocarbon wax or oil.

"Aromatic polyester," as used in the specification and claims, means an ester formed by reaction between a polybasic aromatic acid of the benzene series and a higher alkanol, so as to accomplish complete esterification of all carboxyl functions therein. "Higher alkanol" means a substituted or unsubstituted alkanol of at least six carbon atoms, for example, hexanol, octanol, 2-ethylhexanol, isodecanol, decanol, hexadecanol, octadecanol, docosanol, oleyl alcohol, linoleyl alcohol or the like. A practical limit on the number of carbon atoms in the alkyl is about 22 carbon atoms.

Also included among "higher alkanols" for the purposes of this invention are alkylphenol ethers of alkoxyalkanols, having the formula $$C_aH_{2a+1}—C_6H_4—O(C_xH_{2x}O)_bC_xH_{2x}OH,$$

wherein a is 1–12; b is 1–24 and x is 2 or 3, optionally including blocks of ethyleneoxy and propyleneoxy units.

The esters can be made by reaction between, for example, trimellitic acid, and the selected alkanol, conveniently in a fashion so as to remove or entrain byproduct water. Alternatively, the aromatic polyesters can be prepared by transesterification between a lower ester, e.g. trimethyl trimellitate and the higher alkanol. In such a reaction, the lower boiling alcohol will normally be removed from the reaction site by distillation.

Contemplated among aromatic polyesters are esters of benzene tri-, tetra-, penta- and hexacarboxylic acids, wherein R is as above. Accordingly, esters of prehnitic, mellophanic, pyromellitic, trimesic, trimellitic and hemimellitic acids are included, as well as esters of benzenepentacarboxylic acid and mellitic acid.

Although triesters of any of the benzenetricarboxylic acids can be used, it is preferred to use triesters of 1,2,4-benzenetricarboxylic acid, also known as trimellitic acid. Preferred esters are tris(2-ethylhexyl) trimellitate, trisisodecyl trimellitate, trisisooctyl trimellitate, tridecyl trimellitate, and trihexadecyl trimellitate. It will be understood that mixed esters, such as hexyl, octyl, decyl trimellitate can also be used. Most preferred is tris(2-ethylhexyl) trimellitate (CAS No. 3319-31-1), also known as trioctyl trimellitate, which can be purchased from Eastman Chemical Products, Inc., Kingsport, Tennessee, as Kodaflex $^{R}$TOTM.

The heating media can also contain at least 5% by weight of a cycloaliphatic diester of the formula

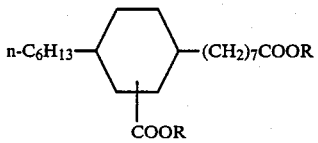

wherein R is substituted or unsubstituted straight or branched chain alkyl of 4–20 carbon atoms or polyoxyalkylene of the formula $HO(C_xH_yO)_nC_xH_y$—, wherein $(C_xH_{2x}O)_n$ is $(CH_2CH_2O)_n$, $(C_3H_6O)_n$ or $(CH_2CH_2O)_p(C_3H_6O)_q$, n is 2–22 and the sum of p+q is n. Other cycloaliphatic diester compounds which can be used are those wherein R is $ArCOO(CH_2CH_2O)_nCH_2CH_2$—, $ArCOO(C_3H_6O)_nC_3H_6$—, $ArCOO(C_2H_4O)_p(C_3H_6O)_qC_3H_6$— or $ArCOO(C_3H_6O)_p(C_2H_4O)_qC_2H_4$—, wherein n, p and q are as above and Ar is substituted or unsubstituted mono- or bicyclic aryl of up to 15 carbon atoms.

The dibasic cycloaliphatic acid employed in making the heating media of this invention is a Diels-Alder adduct of acrylic acid and linoleic acid and can be prepared as described by Ward in U.S. Pat. No. 3,753,968. The diacid has the formula

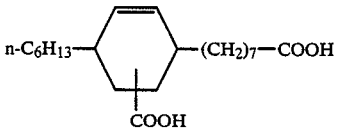

and therefore is a mixture of (5 and 6)-carboxy-4-hexyl-2-cyclohexene-1-octanoic acids. The diacid is available commercially from Westvaco, designated as "Diacid 1550".

Preparation of adducts from conjugated octadecadienoic acid and unsaturated acids and/or their hydrogenation has also been described by Teeter et al, *J. Org. Chem.*, vol. 22 (1957) at 512–514, Ward in U.S. Pat. No. 3,899,476 and Ward et al in U.S. Pat. No. 3,981,682.

The preparation of esters from the $C_{21}$ diacid adduct was reported by Ward et al, *J. Amer. Oil Chemists' Soc.*, vol. 57 (1957) at 219–224. Ethoxylated esters containing 4–119 ethylene oxide units are said to be effective lime soap dispersants. The alkyl esters are reported as being useful in lubricant applications, including use as textile lubricants and plasticizers for PVC.

The diacid can be esterified with alcohols using, for example, acidic catalysts such as p-toluenesulfonic acid, methanesulfonic acid or sulfuric acid. During the esterification, the reaction mixture is preferably also treated with a decolorizing agent, e.g., carbon or clay.

The diacid is reduced following esterification to a saturated compound. A nickel catalyst such as Raney Nickel, nickel on kieselguhr or nickel on alumina can be used. The required amount varies up to 5–10% by weight of the ester.

Hydrogenation is carried out after esterification to prevent nickel from complexing with the free acid. Other catalysts, e.g., platinum or rhodium, avoid this problem, but are prohibitive in cost. The catalyst can be removed by filtration through a plate and frame filter press. The product is the resulting filtrate.

Polyoxyalkylene diesters are prepared by reaction of the diacid, in the presence of an alkaline catalyst, with ethylene or propylene oxide. Reaction will occur at both acid sites. Addition of ethylene oxide is allowed to continue until the product becomes at least dispersible or, preferably, soluble in water. This will correspond to addition of a total of 5–25 ethylene oxide units. The product obtained using ethylene oxide has a structure before hydrogenation represented by the formula.

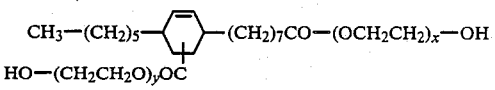

x + y = 5–25

Compounds in which R is $AFCOO(CH_2CH_2O)_nCH_2CH_2$—, etc. are obtained by treating polyoxyalkylene intermediates with an aromatic acid, e.g., benzoic, toluic or mellitic acid, usually with an acidic catalyst. Hydrogenation of the double bond in the cycloaliphatic ring can be done before or after esterification with the aromatic acid.

Representative of substituted alkyl R which may be used in the products of this invention are butoxybutyl, 10-hydroxystearyl, 10-hydroxydecyl, 10-halostearyl, ω-alkanoyloxyalkyl or the like.

Preferred cycloaliphatic diesters for use in accordance with the principles of the invention are those wherein:

(a) R is straight or branched chain alkyl of 4–20 carbon atoms, (b) R is 2-ethylhexyl, lauryl or stearyl, (c) R is $HO(CH_2CH_2O)_nCH_2CH_2$—, (d) R is $HO(C_3H_6O)_nC_3H_6$—, (e) R is $HO(C_2H_4O)_p(C_3H_6O)_qC_3H_6$—, (f) R is $C_6H_5CO(OC_2H_4)_nOC_2H_4$—, (g) R is $CH_3C_6H_4CO(OC_2H_4)_nOC_2H_4$—

(h) R is $C_6H_5CO(OC_3H_6)_nOC_3H_6$—, and (i) R is $CH_3C_6H_4CO(OC_3H_6)_nOC_3H_6$—.

In one preferred embodiment, the heating media of this invention will contain at least 5% by weight of a cycloaliphatic diester, wherein R is alkyl or 6–20 carbon atoms. Most preferably, R is 2-ethylhexyl.

Another preferred heating medium will contain at least 5% by weight of trialkyl trimellitate, wherein alkyl is of 6–22 carbon atoms and at least 5% by weight of cycloaliphatic diester, wherein R is alkyl of 6–20 carbon atoms.

Heating media of this invention can also contain at least 5% by weight of a bisterephthalate ester of an alkylphenylpolyoxyethanol of the formula

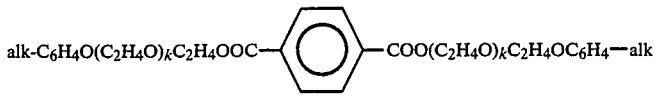

wherein alk is straight or branched chain alkyl of 4–15 carbon atoms and k is 3–20.

It will be understood that alk—$C_6H_5OH$ includes products known as octylphenol, nonylphenol and dodecylphenol, which are alkylation products of propylene or butylene oligomers. These products are actually mixtures of compounds. Nonylphenol, for example is a technical grade mixture of monoalkylphenols, predominantly para-substituted, in which the side chains are isomeric branched chain alkyl. Octylphenol may be mainly 1,1,3,3-tetramethylbutylphenol.

The number of oxyethylene units, designated by "k," also corresponds to a mixture. The product known as nonoxynol is a nonylphenol ether containing, on the average 15 1,2-oxyethanediiyl units (k is 14). The product known as octoxynol is a mixture of polyoxyethylated octylphenols, containing 5–15 oxyethylene units, that is, k is 4–14.

It is preferred that the alkylphenol for the bisterephthalate esters be selected from octylphenol or nonylphenol and that the degree of ethoxylation be 4–6, i.e., k is 3–5.

The bisterephthalate esters can readily be made by ester interchange between an alkylphenylpolyoxyethanol and a lower dialkyl terephthalate, such as dimethyl or diethyl terephthalate.

"Triglyceride fat or oil," as used in the specification and claims, includes, but is not limited to, materials such as naturally-occurring oils and fats, particularly non-drying oils, semi-drying oils, drying oils, lard, tallow and the like. These materials are essentially mixed glycerides of acids of 10–30 carbon atoms, which can be saturated or unsaturated and can be substituted, for example, with a hydroxyl group. The fats or oils used in the dye vehicles of this invention can be used as readily available or can be partially or completely hydrogenated.

Non-drying oils, useful in the practice of this invention, contain large amounts of oleic acid radicals (alkanoyl is oleoyl). Included within this group of oils are palm oil, coconut oil, olive oil, peanut oil, date oil and rice oil. A typical member of this group, olive oil, contains 83.5% of oleic acid units, 9.4% by weight of palmitic acid units, 4.0% by weight of linoleic acid units, 2.0% by weight of stearic acid units and 0.9% by weight of arachidic acid units. Another member of this group, peanut oil, contains 8.3% by weight of palmitic acid units, 3.1% by weight of stearic acid units, 2.4% by weight of arachidic acid units, 3.1% by weight of behenic acid units, 1.1% by weight of lignoceric acid units, 56.0% by weight of oleic acid units and 26.0% by weight of linolelic acid units.

Semi-drying oils contain large amounts of oleic and linoleic acid units. Typical semi-drying oils include corn oil, cottonseed oil, wheat oil, sesame oil, brazil nut oil, soybean oil and rapeseed oil. Corn oil, for example contains 0.1–1.7% by weight of myristic acid units, 8–12% by weight of palmitic acid units, 2.5–4.5% by weight of stearic acid units, 0.2–1.6% by weight of hexadecenoic acid units, 19–49% by weight of oleic acid units and 34–62% by weight of linoleic acid units. Another representative oil of this group, soybean oil, contains 26% by weight of oleic acid units, 49% by weight of linoleic acid units, 11% by weight of linolenic acid units and 14% by weight of saturated acids.

Drying oils contain large amounts of linoleic or linolenic acid units. For example, sunflower oil contains 6.4% by weight of palmitic acid units, 1.3% by weight of stearic acid units, 4.0% by weight of arachidic acid units, 0.8% by weight of behenic acid units, 21.3% by weight of oleic acid units and 66.2% by weight of linoleic acid units. Safflower oil contains 6.4% by weight of palmitic acid units, 3.1% by weight of stearic acid units, 3.1% by weight of arachidic acid units, 0.2% by weight of oleic acid units and 76.6–79.0% by weight of linoleic acid units. It will be understood that when drying oils are used in the practice of this invention, the oils will not have been "boiled," that is, heated with metal-containing catalysts, e.g. lead oxide and manganese dioxide, to begin oxidation and polymerization reactions so that the resulting oil "dries" faster than raw oil.

Naturally-occurring fats, which can be used in the practice of this invention, include lard (hog fat) and tallow. Lard contains a higher proportion of unsaturated acids than beef or sheep fat (tallow). Typical compositions for tallow are 37–43% by weight of oleic acid units, 24–32% by weight of palmitic acid units, 20–25% by weight of stearic acid units, 3–6% by weight of myristic acid units and 2–3% by weight of linoleic acid units.

The fats or oils, particularly the oils, used in the practice of this invention can also be partially or completely hydrogenated. Oils are commonly hydrogenated using nickel catalysts. It is preferred that the triglyceridic vehicles used in the process of this invention contain at least 50% by weight of oleoyl or linoleoyl units or at least 50% by weight of oleoyl, or linoleoyl and stearoyl units.

Particularly preferred is a heating medium using sunflower oil. Also preferred is a heating medium containing 10–90 parts by weight of sunflower oil and 90–10 parts by weight of partially hydrogenated soybean oil. It is preferred that the soybean oil be material commercially designated as partially hydrogenated soybean oil.

Silicone oils or fluids, useful in the practice of this invention, consist of linear polymers of low molecular weight, generally about 4000–25,000. The silicone fluids are commonly based on dimethylsiloxane. The fluids are accordingly made by hydrolysis of dichlorodimethylsilane or mixtures of dichlorodimethylsilane with dichlorodiphenylsilane or other silanes. It is conventional to "cap" the end of the siloxane chain with a trifunctional silicon compound, for example, trimethylsilyl groups, introduced by equilibration with hexamethyldisiloxane. Fluids containing 10–45% by weight of phenyl groups are ordinarily preferred for uses in which high thermal stability is required, including use as a heat transfer medium in accordance with this invention. Other properties of the fluids are set forth in Saunders, "Organic Polymer Chemistry," Chapman and Hall, London (1973), pages 365–366. Of these materials, dimethylsiloxane fluid is particularly perferred as heating medium.

Halogenated hydrocarbons which can be used in the practice of this invention include materials boiling above about 100° C., particularly 1,1,2-trichloroethane, 1,1,2,2-tetrachloroethane, 1,1,2,2-tetrachloroethylene (perchloroethylene) and chlorobenzene. The use of perchloroethylene is preferred.

Glycols include, but are not limited to, ethylene glycol, propylene glycol, butylene glycol, diethylene glycol, triethylene glycol, tetraethylene glycol, dipropylene glycol, tripropylene glycol, dibutylene glycol, tetrabutylene glycol and similar diols, based on five and six carbon alkylene groups, whether linear or branched. The ethers include those of alkanols of 1–6 carbon atoms and include monoethers and diethers, for example, ethylene glycol monomethyl ether, ethylene glycol, propylene glycol monomethyl ether, etc.

Hydrocarbon waxes and oils useful in the practice of this invention are high boiling materials, having a high flash point, commonly known as mineral oil, petrolatum, paraffin oil, paraffin jelly or paraffin wax. These materials are highly refined petroleum products and are more or less linear hydrocarbons of various molecular weights. Mineral oil is preferred as heating medium for the purposes of this invention.

Contemplated equivalents of the heating media set forth above include other inert, high boiling organic materials of whatever origin.

Preferred organic heating media include mixtures of one or more aromatic esters and one or more cycloaliphatic diesters, in 90:10 to 10:90 weight ratios. Most preferred mixtures will include, or consist essentially of, bis(2-ethylhexyl)cycloaliphatic diester and tris(2-ethylhexyl) trimellitate.

The hydrogen peroxide solutions, with which the cotton substrates are impregnated will preferably contain 0.5–15% by weight of hydrogen peroxide.

The aqueous solutions of hydrogen peroxide can also contain an anionic surfactant, in an amount of 0.1–2% by weight of solution. Anionic surfactants include, but are not limited to, alkylbenzene sulfonate salts, salts of sulfated alkanols, and salts of sulfated polyoxyalkylated alkanols or acids. Dodecyl and tridecylbenzene sulfonic acid salts are preferred, particularly alkali metal and isopropyl amine salts thereof.

Although the pH of the hydrogen peroxide solution can be varied over a wide range, it is preferred to use solutions on the alkaline side, especially those of which the pH is adjusted to 10–11 with ammonium, sodium or potassium hydroxide. It will also be appreciated that other textile-treating agents, such as optical brighteners, e.g., styrylnaphthoxazole or DAS triazines, can be applied to the cotton goods from the hydrogen peroxide solution.

The cotton goods are immersed in the hydrogen peroxide bath for a time sufficient to saturate the cotton goods with the peroxide solution. This time is a function of temperature and the presence or absence of surfactant. Generally, however, this step takes of the order of 1–5 minutes and can be accomplished by passing the goods through a bath of the hydrogen peroxide solution. Although any technique may be used to remove excess hydrogen peroxide, above 50–500% by weight pick-up, from the cotton goods, it is generally preferred to use squeeze rolls for this purpose. It will be appreciated that one or a series of rolls can be used and that the number of rolls and the distance between rolls in the series can be determined by routine experimentation.

Entrained organic heating medium can be removed from the treated cotton goods by use of squeeze rolls and subsequent treatment with a halogenated solvent, boiling from 70°–150° C. The halogenated solvent, for example, 1,1,1-trichloroethane, 1,1,2 trichloroethane, 1,1,2-trichloroethylene or perchloroethylene, can be removed by heat drying of the cotton goods. Lower boiling halogenated solvents, particularly fluorochlorohydrocarbons, can also be used.

When the cotton goods are being dyed after the bleaching treatment, it is recommended that the excess organic heating medium be removed in this fashion and that the halogenated wash solvent be removed by heating. The cotton goods can be dyed by application of any direct dye, preferably in a solution of a glycol or higher polyol.

Direct dyes are dyestuffs which dye cellulosic fibers directly. Representative of those which can be used in this step are Chloramine Red B (C. I. 22240, Colour Index, Second Edition, 1956), Diamine Scarlet 3BA-CF (C. I. 23630), Fast Orange W. S. (C. I. 29155), Direct Fast Scarlet 8BC (C. I. 29190), Direct Fast Orange SE (C. I. 29150), Fast Scarlet 4BA (C. I. 29185), Diphenyl Fast Yellow 3GP Supra (C. I. 40001), Fast Yellow 4GL (C. I. 29000), Yellow CH Conc. (C. I. 24895) and Direct Benzol Orange R (C. I. 22130).

The glycol used in the dye bath, alone or combined with esters of groups A, B and C, is preferably triethylene glycol tetraethylene glycol.

BEST MODE FOR CARRYING OUT THE INVENTION

In a most preferred embodiment, the organic heating medium is a mixture of a cycloaliphatic diester in which R is of 6–20 carbon atoms and a trialkyl trimellitate wherein alkyl is of 6–22 carbon atoms; the temperature of the organic heating medium is 125°–185° C.; and the entrained organic heating medium is removed from the cotton substrate by washing at least once with a halogenated solvent boiling from 70° C. to 150° C. and the cotton substrate is dried to remove halogenated solvent.

Without further elaboration, it is believed that one skilled in the art can, using the preceding description, utilize the present invention to the fullest extent. The following specific embodiments are, therefore, to be construed as merely illustrative and not limitative of the remainder of the disclosure in any way whatsoever. In the following examples, the temperatures are set forth uncorrected in degrees Celsius. Unless otherwise indicated, all parts and percentages are by weight.

EXAMPLE 1

Preparation of Cycloaliphatic Diester (R is 2-ethylhexyl)

To a three-necked flask fitted with stirrer, thermometer, nitrogen purge, condenser, side-arm receiver and heating mantle were charged 352 g (1 mole) of Diacid 1550, 273 g (2.1 moles) of 2-ethylhexanol, 1.5 g of p-toluenesulfonic acid and 2 g of decolorizing carbon. Air was purged from the flask with nitrogen and the reaction mixture was stirred and heated to 160°–170° C. for 4–6 hours. Water formed during the reaction was collected in the side-arm receiver. The reaction was continued until the acid value was below 5 mg KOH/g. The catalyst and carbon were removed by filtration.

The ester product and 25 grams of nickel on kieselguhr were charged to a stirred, heated pressure vessel. The mixture was heated to 160°-170° C. and pressurized to 400 psig with hydrogen. A sample was removed after 6-8 hours for determination of the iodine value. The reaction was continued until the iodine value was below 0.5 g of iodine/100 g of sample.

The product was cooled to 50° C. and the catalyst was removed by filtration.

Esters are prepared similarly from:

(1) Diacid 1550 and decyl alcohol, 1:2 molar ratio (2) Diacid 1550 and tridecyl alcohol, 1:2 molar ratio (3) Diacid 1550 and Neodol 25 (a mixture of 12-15 carbon alcohols), 1:2 molar ratio.

EXAMPLE 2

(a) Preparation of Polyoxyethylene Unsaturated Cycloaliphatic Diester, R is $HO(CH_2CH_2O)_nCH_2CH_2$—)

To a stirred autoclave fitted with heating and cooling coils was charged 352 g (1 mole) of Diacid 1550. Catalyst (1.0 g of potassium hydroxide) was charged to the reactor. The temperature was raised to 110° C. and the reactor was vacuum stripped for 30-60 minutes to remove any residual water from previous washing of the reactor or from one or more of the charged reactants or catalyst. The reactor was purged with nitrogen to remove air, evacuated again and purged again with nitrogen. The contents of the reactor were stirred and heated to 140° C. and 100 g (2.3 moles) of ethylene oxide was added to the reactor. The pressure inside the reactor immediately built up to 30-50 psig. After 30-60 minutes' induction time, an exothermic polymerization reaction (to 150°-160° C.) began. The reaction was accompanied by a pressure drop to zero (0 psig) as the ethylene oxide was consumed. Ethylene oxide was added to the reactor to a total of 660 g (15 moles). The temperature was maintained at 150°-160° C. by cooling. Addition of ethylene oxide was stopped and the reaction was allowed to continue for 30 minutes more. The reactor was cooled to 90°-100° C. and purged twice with nitrogen.

A sample of the product had a hydroxyl value of 110 mg of KOH/g (15 moles of ethylene oxide added to the diacid.) The diester was acidified with acetic acid of neutralize the potassium hydroxide catalyst and treated with 3 g of hydrogen peroxide to bleach and lighten the color of the product. The reactor was cooled to 30° C. prior to removing the product, which was filtered through filter paper, using a porcelain filter.

(b) Reduction to the Polyoxyethylene Diester

The product of Example 2(a) and 25 g of nickel on kieselguhr were charged to a stirred, heated pressure vessel. The mixture was heated to 160°-170° C. and pressurized with hydrogen to 400 psig. After 6-8 hours, samples were removed at intervals for determination of the iodine value. The reaction was continued until the iodine value was less than 0.5 g/100 g of sample.

EXAMPLE 3

Aroylpolyoxyethylene Cycloaliphatic Diester

An aroylpolyoxyethylene cycloaliphatic diester was synthesized in a two-liter autoclave fitted with nitrogen purge, condenser and receiver for the removal of by-product water. Charge weights were:

510.0 g.: Diacid 1550
2.0 g.: flake caustic
636.0 g.: ethylene oxide

After purging the system with nitrogen, Diacid 1550 and caustic were heated to 130° C. Ethylene oxide was added over a four-hour period, during which the temperature was kept at 150°-165° C. The resulting ethoxylated product was cooled to 90° C. for removal of a sample. The hydroxyl value was 139. To this intermediate was added:

3.5 g.: acetic acid (glacial)
7.5 g.: methaNesulfonic acid (70%)
340.0 g.: benzoic acid After purging with nitrogen, the temperature of the mixture was raised to and held at 165°-170° C. until the acid value was less than 5 mg KOH per gram. The theoretical amount of water was removed during the reaction and collected in the receiver. The sample was cooled and filtered.

The filtered product was hydrogenated in a two-liter autoclave:

1000.0 g: ethoxylated product, above
50.0 g : Raney nickel
QS : hydrogen

The reduction was run at 100°-125° C. and 200-250 psig until hydrogen consumption ceased. The product was cooled and filtered.

EXAMPLE 4

Bisterephthalate ester is prepared from polyoxyethylated nonylphenol (about 5 oxyethylene units) by heating with dimethyl terephthalate, until distillation of methanol ceases.

EXAMPLE 5

Bleaching of Greige Cotton Towelling

Greige cotton toweling was immersed in aqueous hydrogen peroxide solutions, containing 5-15% by weight of hydrogen peroxide, for 5 sec-2 min. The impregnated cotton material was removed from the bleach bath and squeeze-rolled to 100% pick-up. The material was immediately immersed in a bath of a 20:80 mixture (by weight) of bis(2-ethylhexyl) cycloaliphatic diester of Example 1 and tris(2-ethylhexyl) trimellitate (Eastman) for 30 sec-5 min at 100°-185° C. The towelling was removed from the ester bath, washed with perchloroethylene and dried in an oven.

EXAMPLE 6

(a) The procedure of Example 5 was used to bleach greige cotton towels. Towels were immersed in 5% aqueous hydrogen peroxide solutions at 60° C. for 1 min, squeeze-rolled to 100% pick-up and immediately immersed in the cycloaliphatic diester-triester mixture at 150° C. for 1 min. The towels, after washing with perchloroethylene and drying as above, were bleached white.

In addition, the towels were fluffier and more receptive to further treatment, such as dyeing, than greige toweling treated by conventional desizing, treatment with steam in a J-box, scouring, bleaching in a bath and further scouring.

(b) Towels were bleached as in (a), except that an optical brightener (1.0% by weight of American Hoechst Carbowhite CEF) was added to the aqueous peroxide solution.

EXAMPLE 7

A sample of 100% cotton towel (greige, 5×15 cm) was immersed in 500 ml. of 5% hydrogen peroxide solution at 57° C. for 1 minute, squeeze-rolled to about 100% pick-up and immersed in 500 ml. of the 20:80 diester-triester mixture at 150° C. for 1 min. After removal from the bath, the sample was squeeze-rolled, immersed in two successive perchloroethylene baths at 25° C. and dried in an oven. The resulting bleached towel was much whiter and fluffier than initially.

The towel was wetted with water, squeeze-rolled to about 100% pick-up and immersed for 1 min in a dye bath of blue direct dye (2 g/l) at 120° C. for 1 min. The dye bath comprised a mixture of 20:10:3 by weight of triethylene glycol/NP-5[2-(nonylphenoxytetraethoxy)ethanol]/bis(2-ethylhexyl) cycloaliphatic diester:-tris(2-ethylhexyl) trimellitate 20:80. The thus-dyed towel was squeeze-rolled and immersed in a fixing bath containing 1% by weight of a cationic amino-aldehyde condensate (Cassofix FRN 300, American Hoechst Co.) at pH 5.5. The towel was kept in a first fixing bath for 5 min at 43°–49° C., transferred to a second fixing bath at 43°–49° C. for 1 min and treated in a third fixing bath at 43°–49° C. for 1 min. Little or no coloration was observed in the third bath. The towel was removed from the third fixing bath, dried in an oven, immersed successively in two baths of perchloroethylene at 25° C. and dried in an oven. The dried towel had a level dyeing, which did not bleed upon immersion in 1 liter of water at 80° C. for 5 min.

EXAMPLE 8

(a) A swatch of greige cotton toweling (7.5×15 cm) was stirred for 2 minutes at 65° C. in a bath of 3.0 g of 50% hydrogen peroxide and 1.5 g of sodium dodecylbenzenesulfonate in 150 g of water. The towel was transferred to a bath containing 14 ml of 50% hydrogen peroxide, 1 ml of concentrated ammonium hydroxide and 0.1 g of sodium pyrophosphate decahydrate in 135 ml. of water for 4 min at 48° C. The towel was then plunged into boiling perchloroethylene for 45 sec. and dried. The towel was quite white and had a tensile strength of 76 lb (53435 kg/m$^2$), compared to an initial tensile strength of 42 lb.

(b) A swatch of greige cotton toweling (7.5×15 cm) was treated with an aqueous bath containing 1% by weight of sodium dodecylbenzenesulfonate at 65° C. for 2 min and transferred to a 100 ml. of an aqueous bath containing 0.525 g of sodium hypochlorite for 1 min. at 40° C.

The sample was removed from the hypochlorite bath and washed in a bath of boiling perchloroethylene for 45 sec. Then the swatch was immersed in 150 ml. an aqueous solution containing 0.75 g of hydrogen peroxide (100%), 1 ml of concentrated ammonium hydroxide and 0.1 g of sodium pyrophosphate decahydrate for 4 min. The swatch was washed in boiling perchloroethylene for 45 sec and dried. The dried towel was quite white and had a tensile strength of 50623 kg/m$^2$.

(c) A swatch of greige cotton toweling (7.5×15 mm) was treated for 1 min at 60° C. in an aqueous bath containing 1% by weight of sodium dodecylbenzene-sulfonate. The towel was then treated in a bath of 135 ml of water, 14 ml of 50% hydrogen peroxide, 1 ml of concentrated ammonium hydroxide and 0.1 g of sodium pyrophoshate decahydrate at 48° C. for 4 min. The towel swatch was transferred to a bath of diester-triester mixture, containing 80% by weight of tris(2-ethylhexyl) trimellitate, 19.6% of bis(2-ethylhexyl cycloaliphatic diester, 0.2% of triphenyl phosphite and 0.2% of 2,2'-oxamidobis[ethyl 3-(3,5-di-tert.-butyl-4-hydroxyphenyl)-propionate], at 150° C. and kept in the bath until evolution of steam stopped. The towel, after being washed in perchloroethylene and dried, was white and had a tensile strength of 50623 kg/m$^2$. The tensile strength compared favorably to a tensile strength of 52029 kg/m$^2$ for commercially-bleached cotton toweling.

EXAMPLE 9

Greige cotton toweling was immersed in hydrogen peroxide (as in Example 7) and transferred to a mineral oil bath, comprising Bayol 72 (Exxon), maintained at 100° C. for 1 min. The bleached towel was whiter than that of Example 7 and was oxidized less (Harrison's reagent) than when the diester-triester bath was used.

Attempted removal of the mineral oil by washing in either perchloroethylene or soapy water (3 washes, each of 1 min) left about 1–2% residual mineral oil on the cotton.

EXAMPLE 10

Greige cotton toweling was treated in 5% aqueous hydrogen peroxide solution, containing 3% by weight of the isopropylamine salt of dodecylbenzene-sulfonic acid (Richardson Chemical Co.), at 60° C. for 1 min. The towel swatches were transferred to mineral oil (Bayol 72, Exxon) at 100°–130° C. for 1 min and washed with perchloroethylene or with soapy water. Towel swatches treated in this fashion has much higher tensile strength (67497 kg/m$^2$) than towels treated with aqueous peroxide solutions containing sodium dodecylbenzene sulfonate.

EXAMPLE 11

Greige cotton toweling, after bleaching as in Example 7, was dyed by immersion in a dye bath of 20:10:3 by weight of triethylene glycol/NP-5 [2-(nonylphenoxytetraethoxy)ethanol]/bis(2-ethylhexyl)cycloaliphatic diester:tris(2-ethylhexyl) trimellitate 20:80 at 130°–135° C. The cotton was prewetted with water before immersion in the dye bath. The dye pick-up was 50–500%.

The dyes used were Superlitefast Rubine WLKS Crude, Superlitefast Yellow EFC Crude 214%, Superlitefast Brilliant Blue 3 GLST Crude 165% and Sol-Aqua-Fast Red RL Crude 114% (Crompton and Knowles) at concentrations of 2–4 g/1.

The dyes were fixed on the towelling by immersion in a fixative, Cassofix FRN, adjusted to pH 5–6 with acetic acid. Salt rinses were not required for adequate dye fixation. The temperature of fixation was 43°–49° C. for 1–20 min. After fixation, the towel swatches were squeeze-rolled and dried in an oven. The resulting dyeings were level and much more intense than expected from the amount of dye used in the dye bath.

EXAMPLE 12

(a) Swatches of greige cotton toweling were bleached and then dyed as in Example 7, except that glycerol, tetramethylene glycol and propylene glycol were substituted for triethylene glycol in the dye bath. Results were as in Example 7, except that dyeings using tetraethylene glycol in the bath were deeper than those using triethylene glycol in the bath.

(b) Swatches of greige cotton toweling were bleached and dyed as in Example 7, except that glyceryl monobenzoate, glyceryl monooleate and hexylene glycol were substituted for triethylene glycol in the dye bath. Hexamethylene glycol and glyceryl monooleate baths did not dissolve the dye. Baths containing glyceryl monobenzoate did not give a level dyeing.

EXAMPLE 13

Greige cotton toweling is bleached as in Example 5, using as the heating medium a mixture of bis(tridecyl) cycloaliphatic diester and tris(2-ethylhexyl) trimellitate in 70:30 weight ratio. Similar results are obtained.

EXAMPLE 14

Greige cotton toweling is bleached as in Example 5, except that the treating bath is a mixture of bis(2-ethylhexyl) cycloaliphatic diester and bis(nonylphenoxytetraethoxy) terephthalate in 55:45 weight ratio. Similar results are obtained.

EXAMPLE 15

Bleaching is done as in Example 5, using as the heating medium soy oil, lard or silicone oil. Similar results are obtained.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

I claim:

1. A method for bleaching cotton substrates comprising the steps of:

(a) immersing unbleached cotton substrate in an aqueous solution of hydrogen peroxide at pH 4.5–11 at 15°–90° C. to saturate the cotton substrate with the aqueous solution of hydrogen peroxide;

(b) removing the thus-saturated cotton substrate from the aqueous solution of hydrogen peroxide and removing from the substrate aqueous hydrogen peroxide solution in excess of 50–500% pick-up by weight;

(c) transferring the resulting cotton substrate saturated with 50–500% by weight of aqueous hydrogen peroxide solution to a bath of an inert high boiling organic heating medium, maintained at a temperature between 100° C. and the boiling point or decomposition point of the organic heating medium, for 5 sec-20 min; and (d) removing the cotton substrate from the high boiling organic heating medium and separating entrained organic heating medium from the cotton substrate.

2. The method of claim 1, wherein the organic heating medium comprises one or more of:

A. an aromatic polyester of the formula $C_6H_{z'}(COOR_1)_z$, wherein $R_1$ is substituted or unsubstituted alkyl of 6–22 carbon atoms or the residue of an alkylphenol ether of an alkoxyalkanol; z is 3, 4, 5, or 6 and z' is 6 - z;

B. a cycloaliphatic diester of the formula

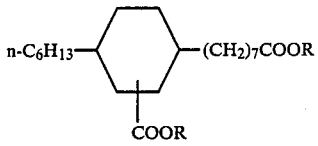

wherein R is substituted or unsubstituted straight or branched chain alkyl of 4–20 carbon atoms or polyoxyalkylene of the formula $R'(OC_xH_{2x})_n$, wherein $(C_xH_{2x}O)_n$ is $(C_2H_4O)_n$—, $(C_3H_6O)_n$— or $(C_2H_4O)_p$ $(C_3H_6O)_q$—; R' is H or ArCO; Ar is substituted or unsubstituted mono- or bicyclic aryl of up to 15 carbon atoms; x is 2 or 3; n is 2–22 and the sum of p+q is n;

C. a bisterephthalate ester of an alkylphenylpolyoxyethanol of the formula

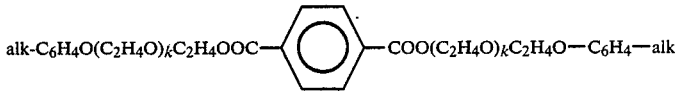

wherein alk is straight or branched chain alkyl of 4–15 carbon atoms and k is 3–20;

D. a triglyceride fat or oil of the formula

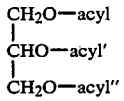

wherein acyl, acyl' and acyl'' each are saturated or unsaturated substituted or unsubstituted linear alkanoyl of an even number of carbon atoms from 10–30 carbon atoms;

E. a silicone oil;

F. a halogenated hydrocarbon;

G. a glycol or glycol ether or

H. a hydrocarbon wax or oil.

3. The method of claim 2, wherein the organic heating medium comprises an aromatic polyester and a cycloaliphatic diester in 90:10 to 10:90 weight ratio.

4. The method of claim 2, wherein the organic heating medium comprises a mixture of bis(2-ethylhexyl) cycloaliphatic diester and tris(2-ethylhexyl) trimellitate in 90:10 to 10:90 weight ratio.

5. The method of claim 2, wherein the organic heating medium comprises tetrachloroethylene.

6. The method of claim 2, wherein the organic liquid medium comprises mineral oil.

7. The method of claim 1, wherein the aqueous solution of hydrogen peroxide contains 0.5–15% by weight of hydrogen peroxide.

8. The method of claim 1, wherein the aqueous solution of hydrogen peroxide contains 0.1–2% by weight of an anionic surfactant.

9. The method of claim 1, wherein the aqueous solution of hydrogen peroxide contains 0.1–2% by weight of an alkali metal salt of an alkylbenzene sulfonic acid.

10. The method of claim 1, wherein the aqueous solution of hydrogen peroxide contains 0.1–2% by weight of an isopropyl amine salt of an alkylbenzenesulfonic acid.

11. The method of claim 1, wherein the pH of the aqueous solution of hydrogen peroxide is 10–11.

12. The method of claim 2, wherein the organic heating medium is a mixture of a cycloaliphatic diester wherein R is of 6–20 carbon atoms and a trialkyl trimellitate wherein alkyl is of 6–22 carbon atoms and the temperature of the organic heating medium is 125°–185° C.

13. The process of claim 1, wherein excess aqueous solution of hydrogen peroxide is removed from the cotton substrate by a squeeze roll.

14. The method of claim 1, wherein entrained organic heating medium is removed from the cotton substrate by washing at least once with a halogenated solvent boiling from 70° C. to 150° C. and the cotton substrate is dried to remove halogenated solvent.

15. The method of claim 1, including the further steps of:

removing entrained organic heating medium with a solvent boiling from 70° C. to 150° C. and drying the cotton substrate to remove the solvent;

wetting the thus-dried cotton substrate with water and dyeing the thus wetted cotton substrate in a dye bath containing a direct dye in a glycol or higher polyol solvent.

16. The method of claim 15, wherein the glycol solvent is triethylene glycol.

17. The method of claim 15, wherein the glycol solvent is tetraethylene glycol.

* * * * *